US005098882A

United States Patent [19]

Teraji et al.

[11] Patent Number: 5,098,882

[45] Date of Patent: Mar. 24, 1992

[54] HEAT-SENSITIVE RECORDING MEDIUM

[75] Inventors: Hiroshige Teraji; Yasunori Shimada; Motokazu Aono; Hisashi Yamamoto, all of Iyomishima, Japan

[73] Assignee: Daio Paper Corporation, Ehime, Japan

[21] Appl. No.: 569,602

[22] Filed: Aug. 20, 1990

[30] Foreign Application Priority Data

Aug. 24, 1989 [JP] Japan ..... 1-218340
Oct. 31, 1989 [JP] Japan ..... 1-284589

[51] Int. Cl.[5] ..... B41M 5/30

[52] U.S. Cl. ..... 503/209; 503/208; 503/217; 503/221

[58] Field of Search ..... 427/150-152; 503/208, 209, 217, 218, 221, 225

[56] References Cited

U.S. PATENT DOCUMENTS 4,925,827 5/1990 Goto et al. ..... 503/207

FOREIGN PATENT DOCUMENTS 0306916 3/1989 European Pat. Off. .

*Primary Examiner*—Bruce H. Hess
*Attorney, Agent, or Firm*—Wenderoth, Lind & Ponack

[57] ABSTRACT

A heat-sensitive recording medium comprising, on a support, a heat-sensitive color-developing layer containing a colorless or light-colored leuco dye (or an electron-donating dye precursor) and a color-developing agent (or an electron-accepting substance) reacting with the leuco dye to develop color as main constituents, said leuco dye being a compound represented by the formula (I):

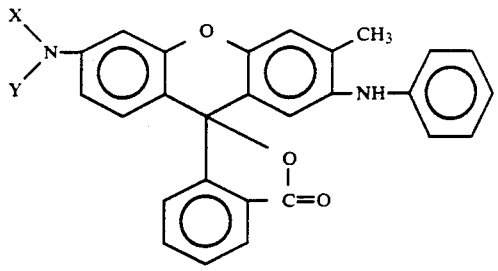

(I)

wherein X represents $CH_3—(CH_2)_3—CH_2$ or $CH_3—CH_2—CH_2$ and Y represents $CH_3—(CH_2)_3—Ch_2$ or $CH_3$, and said heat-sensitive color-developing layer containing at least one of the compounds represented by the general formula (II) and (III):

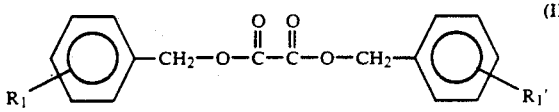

(II)

where $R_1$, $R_1'$ are respectively any one of H, Cl, and $CH_3$, and may be the same with or different from each other:

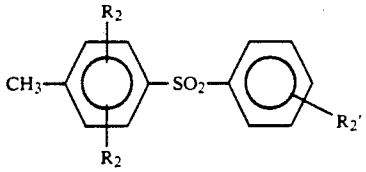

(III)

where $R_2$, $R_2'$ are respectively any one of H and $CH_3$, and may be the same with or different from each other.

9 Claims, No Drawings

HEAT-SENSITIVE RECORDING MEDIUM

BACKGROUND OF THE INVENTION

1. Field of the Invention

The present invention relates to a heat-sensitive recording medium.

2. Description of the Related Art

Conventional heat-sensitive recording mediums are constituted of a heat-sensitive color-developing layer provided on a support such as a paper sheet, a film, etc., in which the heat-sensitive color developing layer is composed of a two-component color-developing system consisting of a colorless or light-colored electron-donating dye-precursor (hereinafter referred to as a "leuco dye"), and electron-acceptor (hereinafter referred to as a "developer"), and additionally a binder, a sensitivity-improving agent, a lubricating agent, a filler, and other auxiliary agents dispersed in the system. Such a material is disclosed, for example, by Japanese Patent Publications No. Sho 43-4160 (1968), and No. Sho 45-14039 (1970).

Such two-component color-developing type of heat-sensitive recording mediums, which are capable of easily developing a color image by heating with a heating element such as a thermal head, a heating pen, etc., have the features below.

(1) The primary color-development eliminates the steps of development and fixing of images, (2) The supply of toner or the like is not necessary, and the maintenance of the recording machine is easy, (3) The quality of the medium resembles that of general purpose paper, and does not cause feeling of unnaturalness, when paper is used as the support, (4) The density of the developed color is high, so that sharp image is obtained, and (5) Various color tones can easily be developed by changing the kind of the leuco dye.

Because of these advantages, the two-component color-developing type of heat-sensitive recording mediums are most commonly employed among heat-sensitive recording mediums. Recently, in particular, the use thereof is remarkably increasing in application fields of facsimiles, printers, instrumentation recorders, labels, and others.

In the field of recent facsimile communication, for example, increase of recording speed is intended with the speed-up of the communication. Accordingly, heat-sensitive recording paper is strongly demanded to be improved in heat responsiveness such that sufficient color density be achieved with less thermal energy.

For the improvement of the heat responsiveness, studies have been made on various development-sensitivity improving agents. However, accompanied with the improvement of the heat responsiveness, undesirable tendency of texture fogging increases. At the moment, no satisfactory heat-sensitive recording medium has not been obtained which satisfies the needs both for high color-developing sensitivity and less texture fogging.

The components mentioned below are contained in the heat-sensitive color-developing layer of the heat sensitive recording medium generally proposed or widely used.

The leuco dyes are exemplified by the following compounds:

Triarylmethane compounds, including 3,3-bis(p-dimethylaminophenyl)-6-dimethylaminophthalide, (i.e., Crystal Violet lactone), 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, etc.

Diphenylmethane compounds, including 4,4'-bis-dimethylaminobenzhydrinbenzylether, N-halophenyl-leucoauramine, N-2,4,5-trichlorophenyl-leucoauramine, etc.

Xanthene compounds, including rhodamine-B-anilinolactam, rhodamine (p-nitrino)lactam, 2-(dibenzylamino)fluoran, 2-phenylamino-6-diethylamino-fluoran, 2-(0-chloroanilino)-6-diethylaminofluoran, 2-(3,4-dichloroanilino)-6-diethylaminofluoran, 2-anilino-3-methyl-6-piperidinofluoran, 2-phenyl-6-diethylaminofluoran, 2-anilino-3-methyl-6-dimethylaminofluoran, 2-anilino-3-methyl-6-N-methyl-N-ethylaminofluran, 2-anilino-3-methyl-6-N-methyl-N-(isopropyl)aminofluoran, 2-anilino-3-methyl-6-N-methyl-N-pentylaminofluoran, 2-anilino-3-methyl-6-N-methyl-N-cyclohexylaminofluoran, 2-anilino-3-methyl-6-diethylaminofluoran, 2-anilino-3-chloro-6-dimethylaminofluoran, 2-anilino-3-methyl-6-N-ethyl-N-isoamylaminofluoran, 2-anilino-3-methyl-6-N-methyl-N-isoamylaminofluoran, 2-anilino-3-chloro-6-diethylaminofluoran, 2-anilino-3-chloro-6-N-methyl-N-ethylaminofluoran, 2-anilino-3-chloro-6-N-methyl-N-(isopropyl)aminofluoran, 2-anilino-3-chloro-6-N-methyl-N-pentylaminofluoran, 2-anilino-3-chloro-6-N-methyl-N-cyclohexylaminofluoran, 2-anilino-3-methyl-6-N-ethyl-N-pentylaminofluoran, 2-anilino-3-chloro-6-N-ethyl-N-pentylaminofluoran, 2-(p-methylanilino)-3-methyl-6-dimethylaminofluoran, 2-(p-methylanilino)-3-methyl-6-diethyaminofluoran, 2-(p-methylanilino)-3-methyl-6-N-methyl-N-ethylaminofluoran, 2-(p-methylanilino)-3-methyl-6-N-methyl-N-(isopropyl)aminofluoran, 2-(p-methylanilino)-3-methyl-6-N-methyl-N-pentylaminofluoran, 2-(p-methylanilino)-3-methyl-6-N-methyl-N-cyclohexylaminofluoran, 2-(p-methylanilino)-3-methyl-6-N-ethyl-N-pentylaminofluoran, 2-(p-methylanilino)-3-chloro-6-dimethylaminofluoran, 2-(p-methylanilino)-3-chloro-6-diethylaminofluoran, 2-(p-methylanilino)-3-chloro-6-N-methyl-N-ethylaminofluoran, 2-(p-methylanilino)-3-chloro-6-N-methyl-N-(isopropyl)aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino)-3-chloro-6-N-ethyl-N-pentylaminofluoran, 2-anilino-3-methyl-6-N-methyl-N-furylmethylaminofluoran, 2-anilino-3-ethyl-6-N-methyl-N-furylmethylaminofluoran, etc.

Thiazine compounds, including
benzoleucomethylene blue,
p-nitrobenzyl leucomethylene blue, etc.

Spiropyrane compounds, including
3-methyl-spiro-dinaphthopyrane,
3-ethyl-spiro-dinaphthopyrane,
3,3'-dichloro-spiro-dinaphthopyrane,
3-benzyl-spiro-dinaphthopyrane,
3-methyl-naphtho-(3-methoxybenzo)-spiropyrane,
3-propyl-spiro-dibenzopyrane, etc.

The color developing agent used in combination with the leuco dye to develop the leuco dye in the heat-sensitive color developing layer in the heat-sensitive recording medium is an organic acidic substance which is solid at a normal temperature and is thermally fusible. The examples are phenol compounds, aromatic carboxylic acid compounds, novolak type phenol resins, and the like. Typical examples are bisphenol derivatives, hydroxybenzoic acid esters, salycylic acid esters, etc., and inorganic acids such as activated clay and active silica.

Among these color developers, typically, some examples of phenol compounds and aromatic carboxylic acid compounds are as follows:
2,2-bis(4'-hydroxyphenyl)propane,
2,2-bis(4'-hydroxyphenyl)pentane,
2,2-bis(4'-hydroxy-3',5'-dichlorophenyl)propane,
1,1-bis(4'-hdyroxyphenyl)cyclohexane,
2,2-bis(4'-hydroxyphenyl)hexane
1,1-bis(4'-hydroxyphenyl)propane,
1,1-bis(4'-hydroxyphenyl)butane
1,1-bis(4'-hydroxyphenyl)pentane,
1,1-bis(4'-hydroxyphenyl)hexane,
1,1-bis(4'-hydroxyphenyl)heptane,
1,1-bis(4'-hydroxyphenyl)-2-methyl-pentane,
1,1-bis(4'-hydroxyphenyl)-2-ethyl-hexane,
1,1-bis(4'-hydroxyphenyl)dodecane,
3,3-bis(4'-hydroxyphenyl)pentane,
1,2-bis(4'-hydroxyphenyl)ethane,
1,1-bis(4'-hydroxyphenyl) sulfide,
1,1-bis(3'-allyl-4'-hydroxyphenyl) sulfone,
1,1-bis(4'-hydroxyphenyl) sulfone,
4-hydroxy-4'-isopropoxydiphenyl sulfone,
1,1-bis(4'-hydroxyphenyl) ether,
2,2-bis(4'-hydroxy-3',5'-dichlorophenyl)butane,
phenyl 2,4-dihydroxybenzoate,
phenyl 2,4-dihydroxy-4'-methyl-benzoate,
phenyl 2,4-dihydroxy-4'-chlorobenzoate,
phenyl 2,4-dihydroxy-6-methylbenzoate,
phenyl 2,4,6-trihydroxybenzoate,
phenyl 2,4-dihydroxy-6,4'-dimethylbenzoate,
phenyl 2,4-dihydroxy-6-methyl-4'-chlorobenzoate,
benzyl 2,4-dihydroxybenzoate,
benzyl 2,4-dihydroxy-4'-methylbenzoate,
benzyl 2,4-dihydroxy-4'-chlorobenzoate,
benzyl 2,4-dihydroxy-6-methylbenzoate,
benzyl 2,4,6-trihydroxybenzoate,
benzyl 2,4-dihydroxy-6,4'-dimethylbenzoate,
benzyl 2,4-dihydroxy-6-methyl-4'-chlorobenzoate,
ethyl 4-hydroxybenzoate,
propyl 4-hydroxybenzoate,
isopropyl 4-hydroxybenzoate,
benzyl 4-hydroxybenzoate,
benzyl 4-hydroxy-4'-chlorobenzoate,
benzyl 4-hydroxy-4'-methylbenzoate,
benzyl 4-hydroxy-4'-ethylbenzoate, etc.

A sensitizing agent (or color-development-improving agent) may be added in the heat-sensitive color-developing layer of the heat-sensitive recording medium, in addition to the above-mentioned leuco dye and the color-developing agent. The sensitizing agent melts at a relatively low temperature to cause the color reaction between the leuco dye and the color developing agent, thereby serving to increase color-developing sensitivity. Examples of known sensitizing agents for such purpose are as below: waxes and nitrogen-containing compounds such as stearic amide, stearic methylenebisamide, oleic amide, palmitic amide, coconut oil fatty acid amide, etc., carboxylic esters, naphthol derivatives, naphthoic ester derivatives, benzoic ester derivatives, and the like.

As described above, various substances are known as the components in heat-sensitive color-developing layers of the heat-sensitive recording mediums. Heretofore, comprehensive studies have been made on heat-sensitive recording mediums which meet the technical requirements, for example, as are demanded typically in high-speed facsimile and energy-saving type facsimile, for high color-developing sensitivity with uniformity of printed letters and reproducibility of images, and which have a constitution for less texture fogging with higher color-developing sensitivity. As the results, various component combinations have been proposed and practiced.

However, the mechanism of color development has not elucidated in detail, and further, the kinds of leuco dyes, color-developing agents, and sensitizing agents are diversified, so that it is not easy to select the satisfactory combination.

Under such a situation, the inventors of the present invention noticed the dye precursor as described below which has fluoran skeleton to form a leuco dye which will not cause irregularity of letter print but will exhibit high reproducibility. Further the inventors of the present invention investigated comprehensively the specific constitution of a heat-sensitive color developing layer having component composition highly compatible especially with such dyes, and completed the present invention.

SUMMARY OF THE INVENTION

An object of the present invention is to provide a heat-sensitive recording medium in which a leuco dye, a color-developing agent, and a sensitizing agent are highly compatible with each other, and which has excellent color-developing sensitivity and exhibits less texture fogging.

The present invention provides a heat-sensitive recording medium comprising, on a support, a heat-sensitive color-developing layer containing a colorless or light-colored leuco dye (or an electron-donating dye precursor) and a color-developing agent (or an electron-accepting substance) reacting with the leuco dye to develop color as main constituents, said leuco dye being a compound represented by the formula (I):

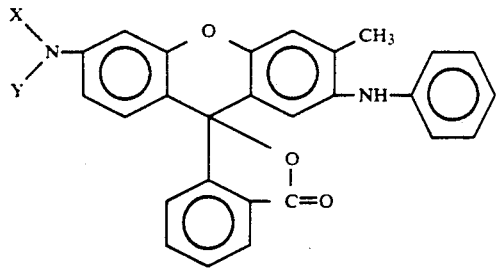

(I)

wherein X represents $CH_3—(CH_2)_3—CH_2$ or $CH_3—CH_2—CH_2$ and Y represents $CH_3—(CH_2)_3—CH_2$ or $CH_3$, and said heat-sensitive color-developing layer containing at least one of the compounds represented by the general formula (II) and (III):

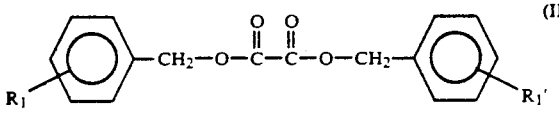

(II)

where $R_1$, $R_1'$ are respectively any one of H, Cl, and $CH_3$, and may be the same with or different from each other:

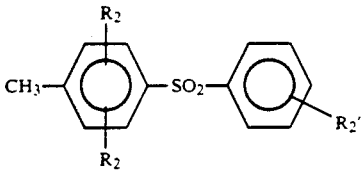

(III)

where $R_2$, $R_2'$ are respectively any one of H and $CH_3$, and may be the same with or different from each other.

DETAILED DESCRIPTION OF THE INVENTION

The color-developing agent contained in the above-mentioned heat-sensitive color-developing layer may be selected from the known color-developing agents mentioned above, among which 1,1'-bis(p-hydroxyphenyl)-propane is particularly preferable. The reason is not precisely known why the heat-sensitive recording medium having the heat-sensitive color-developing layer of the present invention employing the compound of formula (I) as a leuco dye and at least one of the compounds of formulas (II) and (III) as the sensitizing agent exhibits remarkable sensitizing effect.

The reason is assumed at the moment as that the sensitizing agent itself represented by the formula (II) or (III) not only melts rapidly on heating but dissolves and diffuses rapidly into the leuco dye of formula (I) with high saturation solubility, thus helping the rapid formation of colored composition from the leuco dye and the color-developing agent.

The typical examples of the compounds of formula (II) and formula (III) are as below:

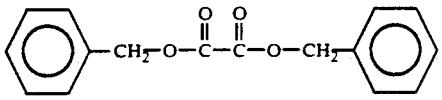

(II-1)

-continued

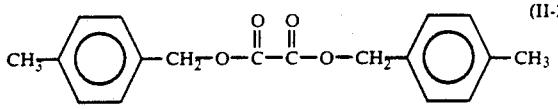

(II-2)

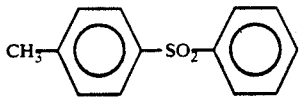

(III-1)

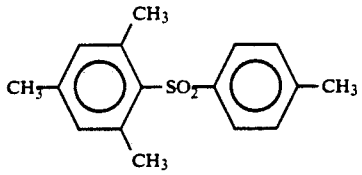

(III-2)

The heat-sensitive color-developing layer of the present invention may contain, together with the sensitizing agent, a substance exhibiting sensitizing effect such as a fatty acid amide like stearic acid amide, stearic acid methylenebisamide, oleic acid amide, palmitic acid amide, coconut fatty acid amide, etc. within such an amount that the desired effects are not impaired.

The heat-sensitive recording medium of the present invention contains suitably the leuco dye, the color-developing agent, and the sensitizing agent in the heat-sensitive color-developing layer respectively in the range from 0.2 to 4.0 g/m$^2$, preferably from 0.3 to 2.2 g/m$^2$.

The heat-sensitive color-developing layer of the present invention preferably contains a filler. The filler is exemplified by inorganic white pigments such as calcium carbonate, clay, calcined clay, silica, zinc oxide, titanium oxide, talc, aluminum hydroxide, magnesium hydroxide, barium sulfate, surface-treated silica, etc., and organic fine particles such as starch, polystyrene resins, urea-formalin resins, etc.

The binder for binding together the leuco dye, the color-developing agent, the organic white pigment, etc. on the support includes water-soluble polymers such as polyvinyl alcohol and derivatives thereof; polyvinylpyrrolidone, starch and derivatives thereof, cellulose derivatives like hydroxyethylcellulose, ethylcellulose, methylcellulose, and carboxymethylcellulose; water-soluble polymers such as alkali salt of styrene-maleic anhydride copolymers, alkali salt of isobutylene-maleic anhydride copolymers, alkali polyacrylate, alkali alginate, polyacrylamides, casein, gelatin, etc.; and various kinds of latexes including stryrene-butadiene copolymer, polyurethane, polyvinyl acetate, polyacrylic acid, etc.

Additionally, depending on the application field, there may be blended a lubricant such as waxes including paraffin wax, carnauba wax, polyethylene wax, methylolstearamide, etc.; zinc stearate, calcium stearate, and the like. There may also be blended a cross-linking agent, etc. for crosslinking the binder for the purpose of improving water-resistance. For the use where storage stability of the record is required, a storability modifier such as a phenol type antioxident is preferably blended.

The heat-sensitive coating material prepared by employing the leuco dye, the color-developing agent, the pigment, the binder and an additional auxiliary agent is applied as a heat-sensitive color-developing layer on the support according to a known conventional method employing a blade coater, an air knife coater, a roller coater, a rod coater, and the like. The formulation of the material may also be conducted by a conventional method.

The materials for the support useful for constituting the heat-sensitive recording medium of the present invention include paper, synthetic paper, a plastic film, nonwoven fabric, resin-impregnated paper, etc. For the purpose of controlling curling of the medium after the coating of the heat-sensitive color-developing layer, a water-soluble polymer, a latex, or the like is preferably applied on the one face or the both faces of the support. Further, an interlayer constituted mainly of the aforementioned inorganic or organic filler is often preferably provided between the support and the heat-sensitive color-developing layer for the purpose of improvement of color-developing sensitivity or prevention of adhesion of residual matter to a thermal element such as a thermal head.

An overcoat layer is preferably provided on the heat-sensitive color-developing layer in order to improve the storability of the heat-sensitive recording medium of the present invention. Such overcoat layer is formed, for example, according to a method disclosed in Japanese Patent Publications No. Sho 58-39078 (1983) and No. Hei 1-17478 (1989).

DETAILED DESCRIPTION OF THE PREFERRED EMBODIMENT

The present invention will be described in more detail referring to Examples.

Embodiment 1

The liquid dispersion A to D containing the leuco dye below dispersed therein, the liquid dispersions P to R containing the color-developing agent dispersed therein, and the liquid dispersions U to Z containing the sensitizing agent dispersed therein were respectively prepared. Each dispersion is prepared by wet-dispersion to have an average particle diameter of 1 to 2 μm by means of a sand grinder. The modified polyvinyl alcohol used was a sulfonated PVA (trade name: Goselan L-3266, made by Nippon Gosei Kagaku K.K.). The "parts" of blending is based on weight.

Leuco dye liquid dispersion (A dispersion)

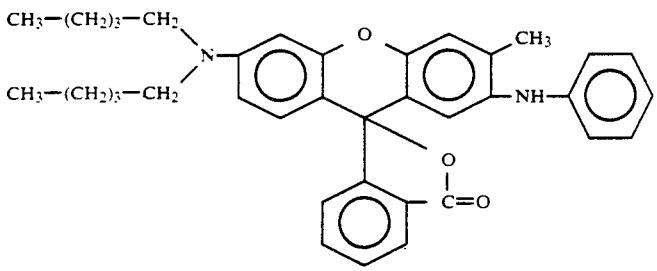

10 parts

| | |
|---|---|
| 10%-modified polyvinyl alcohol | 10 parts |
| Water | 20 parts |
| (B dispersion) | |
| 3-n-dibutylamino-6-methyl-7-anilinofluoran | 10 parts |
| 10%-modified polyvinyl alcohol | 10 parts |
| Water | 20 parts |
| (C dispersion) | |
| 3-(N-ethyl-N-isoamyl)amino-6-methyl-7-anilinofluoran | 10 parts |
| 10%-modified polyvinyl alcohol | 10 parts |
| Water | 20 parts |
| (D dispersion) | |
| 3-(N-methyl-N-propyl)amino-6-methyl-7-anilinofluoran | 10 parts |
| 10%-modified polyvinyl alcohol | 10 parts |
| Water | 20 parts |
| Color-developing agent liquid dispersion | |
| (P dispersion) | |
| 1,1'-bis(p-hydroxyphenyl)propane(disphenol A) | 10 parts |
| 10%-modified polyvinyl alcohol | 10 parts |
| Water | 20 parts |
| (Q dispersion) | |
| 4-hydroxy-4'-isopropoxydiphenyl sulfone | 10 parts |
| 10%-modified polyvinyl alcohol | 10 parts |
| Water | |
| (R dispersion) | |
| 4,4'-hydroxy-3,3'-allyl-diphenyl sulfone | 10 parts |
| 10%-modified polyvinyl alcohol | 10 parts |
| Water | 20 parts |
| Sensitizing agent liquid dispersion | |
| (U dispersion) | |

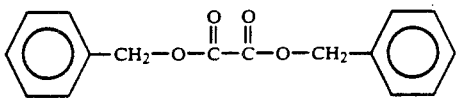

10 parts

-continued

| | |
|---|---|
| 10%-modified polyvinyl alcohol | 10 parts |
| Water | 20 parts |
| (V dispersion) | |
| 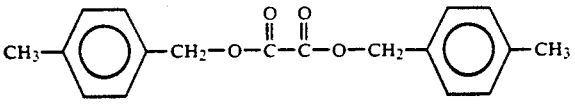 | 10 parts |
| 10%-modified polyvinyl alcohol | 10 parts |
| Water | 20 parts |
| (W dispersion) | |
| 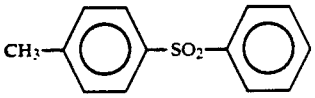 | 10 parts |
| 10%-modified polyvinyl alcohol | 10 parts |
| Water | 20 parts |
| (X dispersion) | |
| 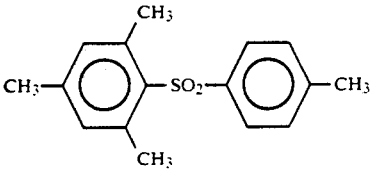 | 10 parts |
| 10%-modified polyvinyl alcohol | 10 parts |
| Water | 20 parts |
| (Y dispersion) | |
| m-terphenyl | 10 parts |
| 10%-modified polyvinyl alcohol | 10 parts |
| Water | 20 parts |
| (Z dispersion) | |
| p-benzylbiphenyl | 10 parts |
| 10%-modified polyvinyl alcohol | 10 parts |
| Water | 20 parts |

The heat-sensitive coating liquids of the combinations shown in Table 1 below were prepared in such a manner that the leuco dye liquid dispersion A, B, C, or D, the color-developing agent liquid dispersion P, Q, or R, the sensitizing agent liquid dispersion U, V, W, X, Y, or Z, and 30% calcium carbonate liquid dispersion were mixed in the mixing ratio of 10 part, 15 parts, 15 parts, and 10 parts respectively, and further thereto 10 parts of a 10% solution of completely saponified type of polyvinyl alcohol (average polymerization degree: approximately 1000). The calcium carbonate used was CALLIGHT SA made by Shiraishi Kogyo K.K.

An interlayer and the above-mentioned heat-sensitive coating liquid were applied respectively in an amount of from 9 to 10 g/m$^2$, and from 4 to 5 g/m$^2$ on a wood-free paper sheet of a basis weight of 45 g/m$^2$ to prepare a heat-sensitive recording medium. The interlayer employed was a layer constituted of an inorganic filler mainly composed of calcined clay and a binder composed of a styrene-butadiene latex, where the ratio of the inorganic filler to a binder was 100:10 (by dry weight).

The heat-sensitive recording mediums thus prepared as shown in Table 1 were respectively treated with a supercalender to give a Bekk smoothness within the range of from 400 to 600 seconds, and the color-developing sensitivity was measured by printing with a thermal head printer made by Okura Denki K.K.

The density of the developed color was measured with a Macbeth densitometer (Model RD-5143 made by Macbeth Co.) at an applied power of 0.4 W/dot, a pulse period of 4.0 ms, and a thermal head resistance of 1191 Ω. The levels of the color-developing sensitivity measured are shown in Table 1.

Table 1 shows that the heat-sensitive recording mediums of Examples employing the specific constitution of the present invention have superior color-developing sensitivity in comparison with those of Comparative examples, and those of Examples 1–4 exhibit especially excellent color-developing sensitivity.

Embodiment 2

Experiments were made in the same way as Embodiment 1 except that the compound of the following chemical structure was used for "A dispersion" and the results were substantially same as obtained in Embodiment 1.

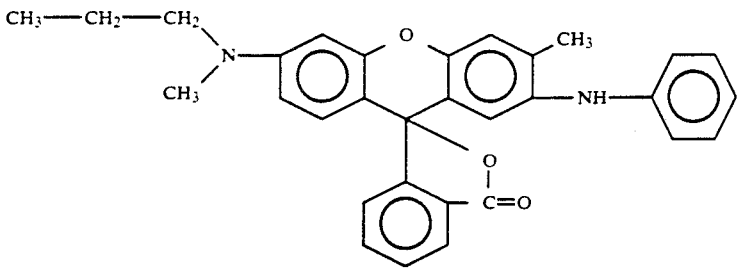

Incidentally, although the above Examples are described by employing specific materials in specific amounts, various changes and modifications are naturally included within the scope of the comprehensive intention and insight of the present invention.

As described above in detail, the present invention provides a heat-sensitive recording medium which exhibits a high density of developed color in high color sensitivity. Therefore, the present invention is greatly useful industrially.

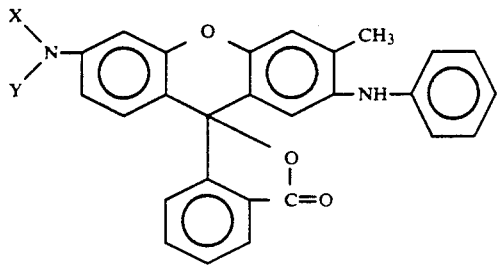

(I)

TABLE 1

| | Heat-Sensitive Color-Developing Layer | | | | |
|---|---|---|---|---|---|
| | Leuco Dye Liquid Dispersion | Color-Developing Agent liquid Dispersion | Sensitizing Liquid Agent Dispersion | Melting Point of Sensitizing Agent (°C.) | Color-Developing Sensitivity Level |
| Example 1 | A | P | U | 80-81 | ◎ |
| Example 2 | A | P | V | 102-103 | ◎ |
| Example 3 | A | P | W | 95.5-98 | ◎ |
| Example 4 | A | P | X | 102-104.5 | ◎ |
| Example 5 | A | Q | U | 80-81 | ○ |
| Example 6 | A | R | U | 80-81 | ○ |
| Comparative Example 1 | A | P | Y | 86-87 | X |
| Comparative Example 2 | A | P | Z | 85-86.4 | X |
| Comparative Example 3 | B | P | U | 80-81 | Δ |
| Comparative Example 4 | B | P | V | 102-103 | Δ |
| Comparative Example 5 | B | P | W | 95.5-98 | Δ |
| Comparative Example 6 | B | P | X | 102-104.5 | Δ |
| Comparative Example 7 | C | P | U | 80-81 | Δ |
| Comparative Example 8 | D | P | U | 80-81 | Δ |

◎ Especially superior
○ Superior
Δ Slightly inferior
X Inferior

What is claimed is:

1. A heat sensitive recording medium comprising, a support, a heat-sensitive color-developing layer disposed on said support and containing a colorless or light-colored electron-donating dye precursor and an electron-accepting substance to react with the dye precursor to develop color, said dye precursor being a compound represented by the formula (I):

wherein X represents $CH_3—(CH_2)_3—CH_2$ or $CH_3—CH_2—CH_2$ and Y represents $CH_3—(CH_2)_3—CH_2$ or $CH_3$, and said heat-sensitive color-developing layer containing at least one of the compounds represented by the general formula (II) and (III):

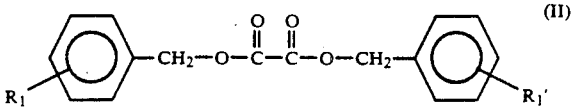

(II)

where $R_1$, $R_1'$ are respectively any one of H, Cl, and $CH_3$, and may be the same with or different from each other:

(III)

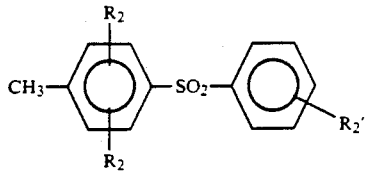

where $R_2$, $R_2'$ are respectively any one of H and $CH_3$, and may be the same with or different from each other.

2. The heat-sensitive recording medium according to claim 1, wherein the electron-accepting substance is 1,1'-bis(p-hydroxyphenyl)propane.

3. The heat-sensitive recording medium according to claim 1 or claim 2, wherein the compound of the general formula (II) contained in said heat-sensitive color-developing layer is a compound having the following formula:

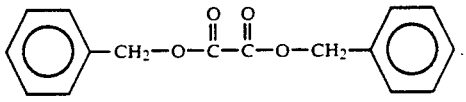

4. The heat-sensitive recording medium according to claim 1 or claim 2, wherein the compound of the general formula (II) contained in said heat-sensitive color-developing layer is a compounds having the following formula:

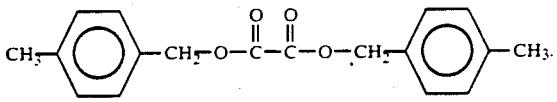

5. The heat-sensitive recording medium according to claim 1 or claim 2, wherein the compound of the general formula (III) contained in said heat-sensitive color-developing layer is a compound having the following formula:

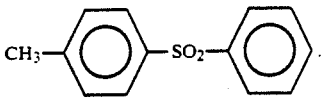

6. The heat-sensitive recording medium according to claim 1 or claim 2, wherein the compound of the general formula (III) contained in said heat-sensitive color-developing layer is a compound having the following formula:

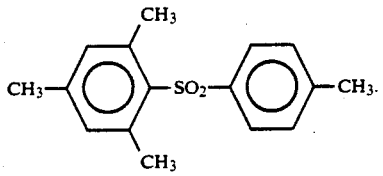

7. The heat-sensitive recording medium according to claim 1, wherein said heat-sensitive color-developing layer further contains a sensitizing agent selected from the group consisting of stearic acid amide, stearic acid methylenebisamide, oleic acid amide, palmitic acid amide, coconut fatty acid amide.

8. The heat-sensitive recording medium according to claim 7, wherein the said color-developing layer contains the electron-donating dye precursor, the electron-accepting substance and the sensitizing agent respectively in a range from 0.2 to 4.0 $g/m^2$, preferably from 0.3 to 2.2 $g/m^2$.

9. The heat-sensitive recording medium according to claim 1, wherein said color-developing layer further comprises filler and binder.

* * * * *